US009226595B2

(12) United States Patent
Jackson

(10) Patent No.: US 9,226,595 B2
(45) Date of Patent: Jan. 5, 2016

(54) CHILD CONTAINMENT DEVICE WITH MATTRESS RETAINING MECHANISM

(71) Applicant: KIDS II, INC., Atlanta, GA (US)

(72) Inventor: Peter Jackson, Alpharetta, GA (US)

(73) Assignee: Kids II, Inc., Atlanta, GA (US)

( * ) Notice: Subject to any disclaimer, the term of this patent is extended or adjusted under 35 U.S.C. 154(b) by 0 days.

(21) Appl. No.: 13/903,703

(22) Filed: May 28, 2013

(65) Prior Publication Data

US 2013/0312178 A1 Nov. 28, 2013

Related U.S. Application Data

(60) Provisional application No. 61/651,609, filed on May 25, 2012.

(51) Int. Cl.
*A47D 13/06* (2006.01)
*A47D 7/04* (2006.01)

(52) U.S. Cl.
CPC *A47D 13/06* (2013.01); *A47D 7/04* (2013.01); *A47D 13/063* (2013.01)

(58) Field of Classification Search
CPC ... A47D 13/063; A47D 13/061; A47D 13/06; A47D 7/04; A47D 7/01; A47D 7/002; A47D 7/00; A47D 9/005; A47D 9/00
USPC ..... 5/93.1, 93.2, 95, 97, 98.1, 99.1, 655
See application file for complete search history.

(56) References Cited

U.S. PATENT DOCUMENTS 2,544,428 A * 3/1951 Judy ..... A47D 13/065 5/94
2,563,915 A * 8/1951 Boisselier ..... A47D 13/063 5/98.3
2,790,978 A * 5/1957 Tigrett ..... A47D 13/063 220/6
2,974,325 A * 3/1961 Mango ..... 5/98.1
3,203,011 A * 8/1965 Faludi ..... 5/94
4,070,716 A * 1/1978 Satt et al. ..... 5/99.1
6,112,347 A * 9/2000 Tharalson ..... A47D 7/04 5/2.1
7,013,505 B2 * 3/2006 Martin ..... 5/95
7,739,759 B2 * 6/2010 Mendes et al. ..... 5/93.1
7,882,579 B2 * 2/2011 Jackson et al. ..... 5/93.1
8,141,186 B2 * 3/2012 Burns et al. ..... 5/98.1
8,201,291 B2 * 6/2012 Burns et al. ..... 5/93.2
2005/0034232 A1 * 2/2005 Martin ..... 5/95
2006/0000019 A1 * 1/2006 Martin ..... 5/99.1
2009/0077738 A1 * 3/2009 Burns et al. ..... 5/93.1
2009/0077739 A1 * 3/2009 Mendes et al. ..... 5/93.1
2009/0077740 A1 * 3/2009 Jackson et al. ..... 5/93.1
2009/0077741 A1 * 3/2009 Burns et al. ..... 5/93.2
2009/0077742 A1 * 3/2009 Burns et al. ..... 5/93.2
2013/0312178 A1 * 11/2013 Jackson ..... 5/93.1

* cited by examiner

*Primary Examiner* — Robert G Santos

(74) *Attorney, Agent, or Firm* — Katherine D. Buchanan; Andrea P. Nguyen; Joseph W. Staley

(57) ABSTRACT

The present invention relates generally to the field of child containment devices, and specifically to a child containment device including a mechanism for holding a mattress in place on the floor of the containment device. According to an example embodiment, the invention comprises a side wall enclosure formed from one or more sidewall panels and a floor panel coupled to the sidewall enclosure to define a receptacle for receiving an infant or child. The invention further includes a mattress for placement upon the floor panel. A mattress retaining mechanism is coupled to the sidewall enclosure and is configured to hold the mattress in place against the floor panel, such that horizontal and vertical movement of mattress is considerably reduced or eliminated.

14 Claims, 3 Drawing Sheets

CHILD CONTAINMENT DEVICE WITH MATTRESS RETAINING MECHANISM

CROSS-REFERENCE TO RELATED APPLICATION

This application claims the priority benefit of U.S. Provisional Patent Application Ser. No. 61/651,609 filed May 25, 2012, the entirety of which is hereby incorporated herein by reference for all purposes.

TECHNICAL FIELD

The present invention generally relates to the field of child containment devices, and more particularly, to a child containment device having a mechanism for retaining a mattress against the floor of the containment device.

BACKGROUND

Child containment devices (which encompass play yards, play pens, play cots, bassinets, co-sleepers, and the like) typically comprise multiple sidewall panels and a floor panel which are supported by a frame structure. A mattress is often placed on top of the floor panel to provide a firm, cushioned surface for a child to stand, sit, or lie on.

Conventional child containment devices typically include means for holding the mattress against the floor panel to prevent the mattress from shifting as the child moves around. Known child containment devices utilize hook and loop fasteners to help keep the mattress in place on the floor panel. The downside of this design is that hook and loop fasteners quickly wear out, offer a weak connection, and can fail under relatively light forces. Other known child containment devices utilize elastic straps that are anchored to the floor panel and can be stretched over the corners of the mattress to hold it against the same. However, the straps can be easily released by a child within the containment device, allowing the mattress to move out of place. This method also requires multiple steps to secure the mattress, as each strap must be individually stretched over a corner of the mattress. Further, this design presents a safety hazard, as a child can get their feet and hands stuck between a strap and the mattress.

As a result, it can be seen that needs exist in the art for a mechanism that at least more reliably holds the mattress in place, requires fewer steps to secure the mattress, and which is safer for a child occupant. The present invention addresses these needs and others.

SUMMARY

The present invention generally relates to child containment devices. Example embodiments of the invention comprise a sidewall enclosure formed by one or more sidewall panels and a floor panel coupled to the sidewall enclosure. A mattress is also provided for placement upon the floor panel. The sidewall enclosure includes a mattress retaining mechanism coupled thereto that is configured to retain the mattress against the floor panel.

According to an example embodiment of the invention, the mattress retaining mechanism comprises one or more elastic straps, or similar resilient members, coupled to the sidewall enclosure. The elastic straps are positioned on the sidewall enclosure proximate the floor panel, and are configured to bias a portion of the sidewall enclosure towards the interior of the child containment device, forming a pocket between each strap and the floor panel. Each pocket is configured to receive a section of the mattress, such that vertical and horizontal movement of the mattress with respect to the floor panel is prohibited.

According to another example embodiment of the invention, the mattress retaining mechanism comprises at least one strap having a length that is selectively adjustable. The adjustable strap is positioned on the sidewall enclosure proximate the floor panel and is configured to force a portion of the sidewall enclosure inward to define a pocket that accommodates a section of the mattress.

According to yet another example embodiment of the invention, the mattress retaining mechanism comprises at least one fastener that can be selectively engaged and disengaged by a user. The fastener is positioned on the sidewall enclosure proximate the floor panel, and when engaged, is configured to force at least a portion of the sidewall enclosure inward to define a pocket that accommodates a section of the mattress.

Hereafter, a brief description of example embodiments of the present inventions is disclosed. Various changes and modifications to such a child containment device and mattress retaining mechanism, beyond those explicitly mentioned herein, are contemplated as being within the scope of the present invention. Notably, it is contemplated that the orientation, quantity, material and construction method of certain components of the invention may be modified.

BRIEF DESCRIPTION OF THE DRAWINGS

Reference will now be made to the accompanying drawings, which are not necessarily drawn to scale, and wherein.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
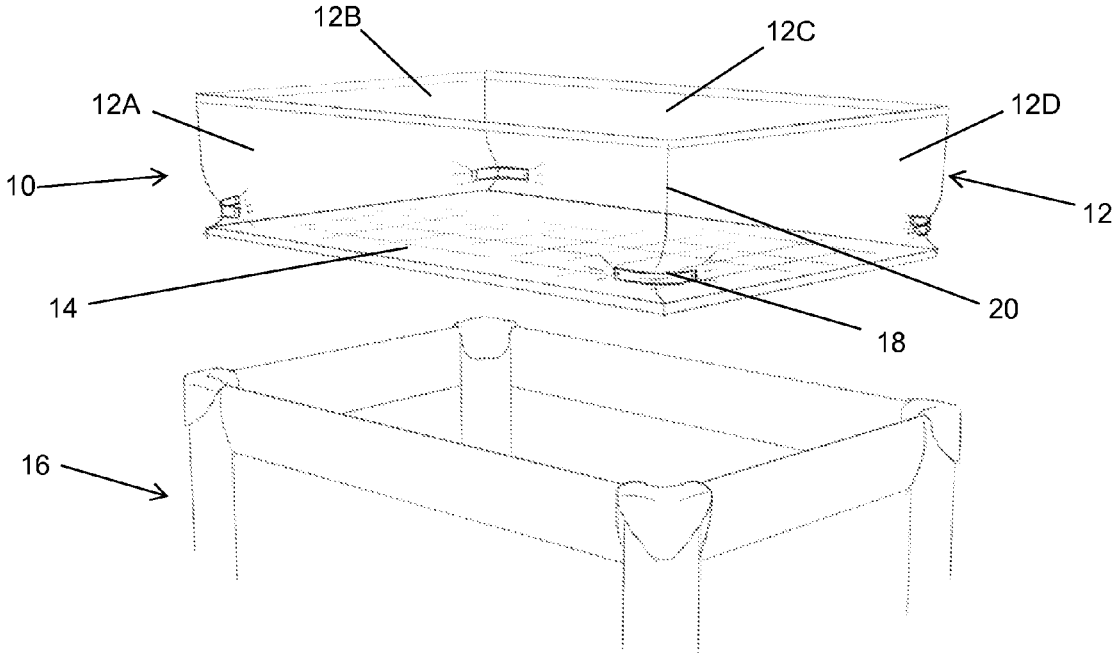
FIG. 1 is a perspective view of a bassinet having a mattress retaining mechanism in accordance with the present invention.
Figure 2:
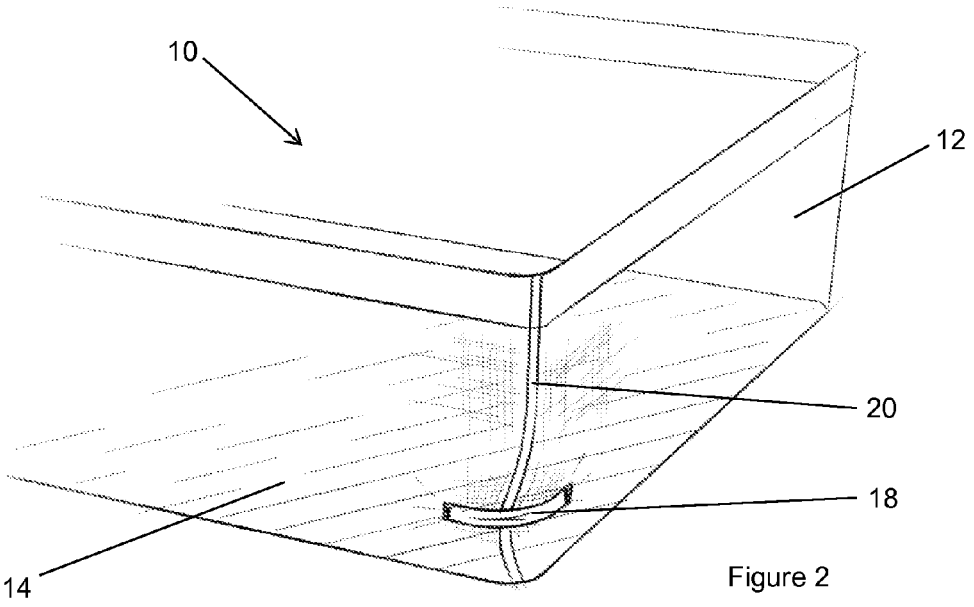
FIG. 2 is a partial perspective, close-up view of the bassinet of FIG. 1.

With reference now to the drawing figures, wherein like reference numbers represent corresponding parts throughout the several views, FIG. 1 and FIG. 2 illustrate a child containment device having a mattress retaining mechanism according to an example embodiment of the invention. In this example embodiment, the child containment device is a bassinet 10 comprising a sidewall enclosure 12 formed by a plurality of sidewall panels 12A-D coupled together along corner seams or edges 20. A floor panel 14 is coupled to the sidewall enclosure 12, which together define a receptacle for receiving a child. The bassinet 10 is configured to be suspended within a play yard 16. According to alternative embodiments of the invention, the child containment device can be a play yard, crib, co-sleeper, or other similar enclosure for receiving a child. Furthermore, while the cross-sectional shape of the child containment device depicted herein is generally rectangular, alternative embodiments can be square, triangular, circular, or other shapes as desired.

Figure 4:
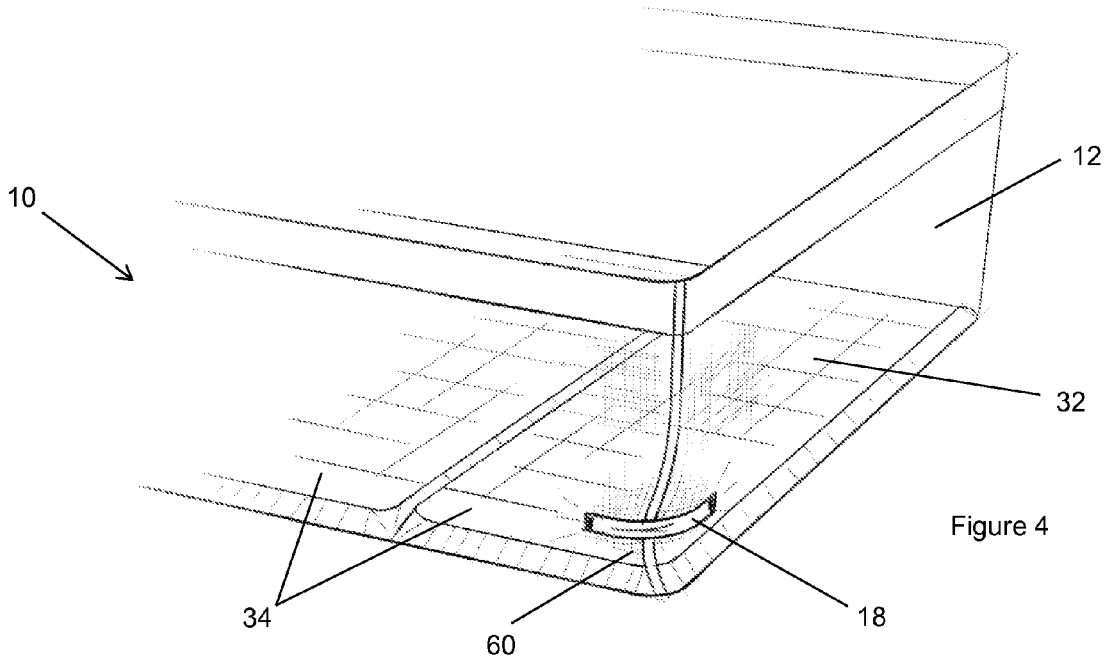
FIG. 4 is another partial perspective view of the bassinet of FIG. 1, shown with a mattress positioned therein.

The mattress retaining mechanism comprises a plurality of resilient elastic straps 18 coupled to the sidewall enclosure 12. In the illustrated embodiment, the straps 18 are sewn to the sidewall enclosure 12, but in other embodiments of the invention, the straps can be permanently or removably coupled to the sidewall enclosure by alternative attachment means (e.g. glue, clips, hooks, etc.). A strap 18 is positioned at each vertical corner edge 20 of the sidewall enclosure 12 proximate a corner of the floor panel 14, such that the strap 18 is substantially perpendicular to the length of the edge 20. In its neutral state, each elastic strap 18 is partially extended, biasing a portion of the sidewall enclosure 12 inward to extend over the corresponding corner of the floor panel 14. The gap between each elastic strap 18 and the floor panel 14 forms a pocket 60 that is configured to receive a corner of a mattress 32, as illustrated in FIG. 4. The straps 18 are preferably located on the exterior surface of the sidewall enclosure 12, as shown, such that a child occupant cannot access the straps 18. However, alternative embodiments of the invention can have straps 18 located on the interior surface of the sidewall enclosure 12. Also, other example embodiments can include more or fewer straps 18 positioned anywhere on the sidewall enclosure 12.

Figure 3:
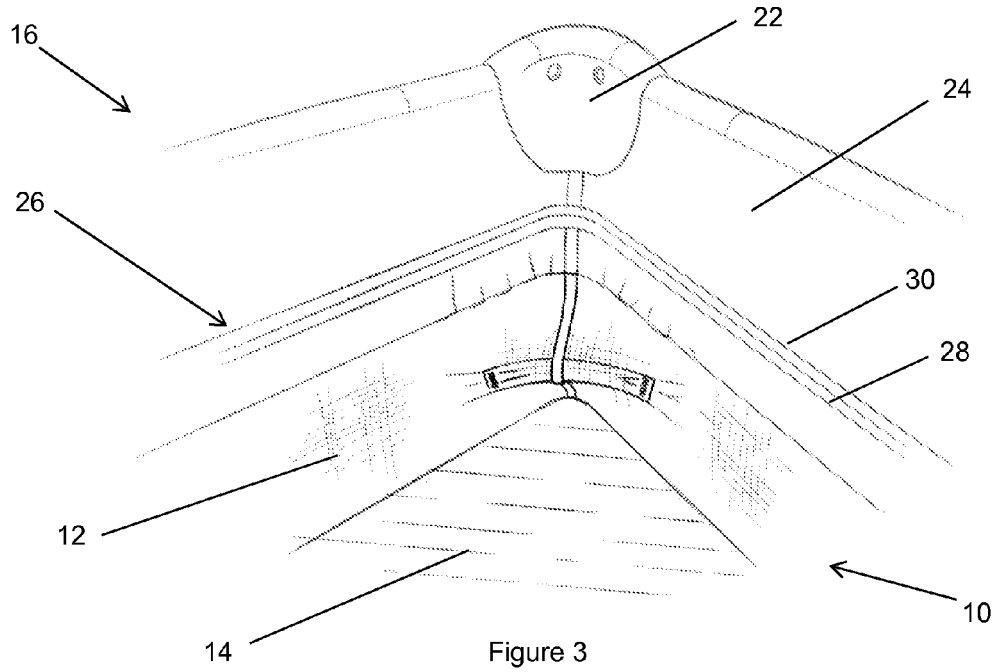
FIG. 3 is another partial perspective view of the bassinet of FIG. 1 coupled to a play yard.

FIG. 3 illustrates the bassinet 10 of FIG. 1 removably coupled to a play yard 16. The play yard comprises a frame 22 configured to rest on a support surface (e.g. a floor) and a play yard liner 24 supported by the frame 22. The bassinet 10 can be suspended within the play yard 16 by coupling the bassinet 10 to the liner 24, or the frame 22, or otherwise suspended therein. In the embodiment depicted in FIG. 3, the bassinet 10 is removably coupled to the liner 24 by way of a selectively engagable zipper fastener 26. The upper edge of the bassinet sidewall enclosure 12 includes a row of teeth 28 configured to mate with a corresponding row of teeth 30 on the liner 24 to attach the bassinet 10 to the play yard 16. Different example embodiments of the invention can employ other conventional fasteners to secure the bassinet 10 to the play yard 16 (or to another support structure), such as hooks, ties, buckles, or snaps, to name a few.

FIG. 4 illustrates a mattress 32 positioned within the bassinet 10 and held securely in place on the bassinet floor panel 14 by the mattress retaining mechanism. The mattress 32 can be optionally comprised of one or more substantially rigid boards 34. The boards 30 can be hingedly attached to one another, such that the mattress 32 is convertible between an expanded configuration, wherein the boards 34 are aligned in a substantially horizontal orientation to provide a generally flat surface for supporting a child, and a collapsed configuration, wherein the mattress 32 can be folded up for storage or travel. Alternatively, the mattress 32 can be a standard flat mattress that does not fold. The mattress 32 also includes a layer of cushioning material that provides a comfortable surface on which a child can rest or play. Preferably, the mattress 28 is sized and shaped to substantially match the size and shape of the floor panel 14.

To position the mattress 32 in place on the bassinet floor panel 14, the mattress 32 can be bent at the hinges between the boards 34, placed on to the floor panel 14, and then unfolded in to the substantially flat expanded configuration. Each corner of the mattress 32 is configured to nestle in a pocket 60 defined by the gap between the floor panel 14 and a corresponding elastic strap 18. Ideally, the height of each pocket 60 is approximately equal to the height of the mattress 32, such that the mattress corners fit snugly in the pockets 60. This retains the mattress 32 in place against the floor panel 14 to prevent accidental horizontal and vertical shifting of the mattress 32. In other embodiments, the height of the pockets 60 can be slightly greater or slightly less than the height of the mattress 32, and the pockets 60 will still effectively retain the mattress 32 against the floor panel 14.

The mattress 32 can also be installed in the bassinet 10 while oriented in the flat expanded configuration. As the flat mattress 32 is lowered down into the bassinet 10, the corners of the mattress 32 push against the elastic straps 18, causing the straps 18 to lengthen and deflect outwardly. Once the mattress 32 is pushed past the elastic straps 18 and positioned on the floor panel 14, the straps 18 deflect back inwardly over the corners of the mattress 32.

Figure 5:
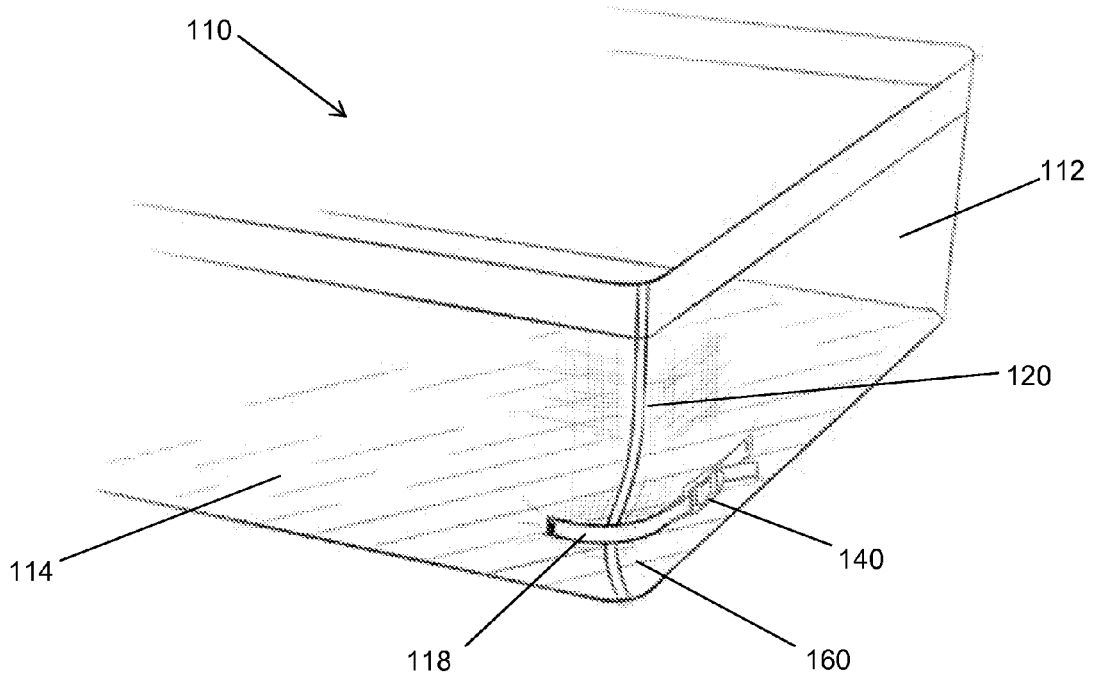
FIG. 5 is a partial perspective view of a bassinet having a mattress retaining mechanism according to a second example embodiment of the present invention.

FIG. 5 illustrates another example embodiment of the present invention. In this embodiment, a bassinet 110 comprising a sidewall enclosure 112 and a floor panel 114 serves as the child containment device. The mattress retaining device comprises a plurality of straps 118 coupled to the sidewall enclosure 112. A strap 118 is positioned at each vertical corner edge 120 of the sidewall enclosure 112 proximate the floor panel 114. The straps 118 are formed from a nylon webbing material, but can also be formed from any other suitable flexible material. Each strap 118 includes an adjustment buckle 140 for selectively adjusting the length of the strap 118. When the strap 118 is shortened, a portion of the sidewall enclosure 112 is forced inward towards the interior of the bassinet 110, forming a pocket 160 between the floor panel 114 and the strap 118 that is configured to receive a corner of a mattress. The adjustment buckle 140 can also be used to adjust the snugness of the pocket 160 around the corner of the mattress, as needed. When the strap 118 is lengthened, the mattress can be easily inserted into or removed from the bassinet 110.

Figure 6:
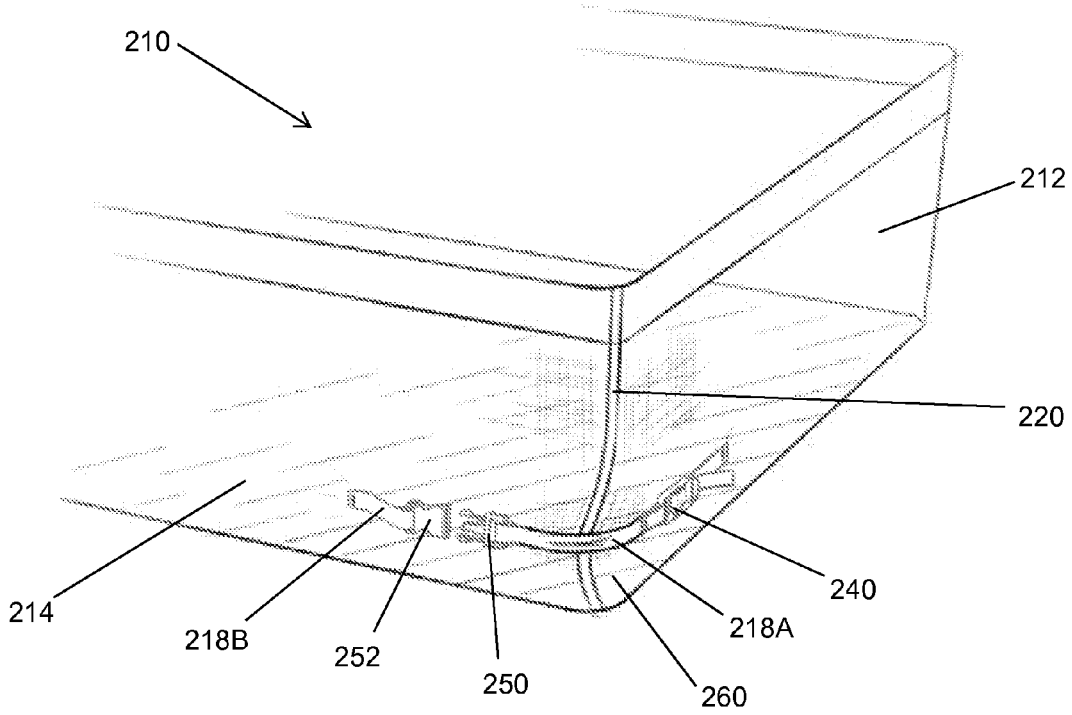
FIG. 6 is a partial perspective view of a bassinet having a mattress retaining mechanism according to a third example embodiment of the present invention.

FIG. 6 illustrates yet another example embodiment of the present invention. Again, in this embodiment, the child containment device is a bassinet 210 comprising a sidewall enclosure 212 and a floor panel 214. The mattress retaining mechanism comprises a pair of first and second straps 218A, 218B coupled to each vertical corner edge 220 of the sidewall enclosure 212. Each first and second strap 218A, 218B comprises a first end that is sewn or otherwise attached to the sidewall enclosure 212 and a second end that is loose. The first and second straps 218A, 218B can be formed from nylon webbing, elastic bungee material, or any other suitable flexible material. Each first strap 218A includes a male buckle component 250 coupled to its loose end and each second strap

218B includes a female buckle component 252 coupled to its loose end and configured to selectively engage with a corresponding male buckle component 250. When the female buckle component 252 and the male buckle component 250 are disengaged, a mattress can be easily inserted in to or removed from the bassinet 210. When the female buckle component 252 and the male buckle component 250 are engaged, the first and second straps 218A, 218B force a portion of the sidewall enclosure 212 inward to create a pocket 260 for receiving a corner of the mattress. The mattress retaining device can also include an adjustment buckle 240 for selectively adjusting the length of the first and/or second straps 218A, 218B.

Various changes and modifications to such a child containment device and mattress retaining mechanism, beyond those explicitly mentioned herein, are contemplated as being within the scope of the present invention. The particular configurations and objectives described herein are merely exemplary and are in no way limiting. For example, the mattress retaining mechanism can be utilized on many different types of children's furniture, such as cribs, play yards, play pens, co-sleepers, and the like. Furthermore, while some preferred materials for various components of the invention are described herein, they are merely suggestions and should not be construed as limiting. Also, the mattress retaining mechanism is not limited to the embodiments described herein and those skilled in the art will appreciate that various other embodiments will fall within the scope of the invention. For example, the mattress retaining mechanism could utilize clips, magnets, springs, or other means to push, pull, or bias, cinch, or otherwise impel the sidewall enclosure inward to define pockets that can receive a section of a mattress. Moreover, there can be features added to the invention that are not discussed herein. For example, the child containment device can have a secondary mattress retaining mechanism, such as hook and loop fasteners between the mattress and the floor panel, as an extra safety measure.

While the invention has been described with reference to preferred and example embodiments, it will be understood by those skilled in the art that a variety of modifications, additions and deletions are within the scope of the invention, as defined by the following claims.

What is claimed is:

1. A child containment device comprising:

a sidewall enclosure;

a floor panel coupled to the sidewall enclosure; and a mattress retaining mechanism coupled to the sidewall enclosure proximate and above the floor panel and distal from a top edge of the sidewall enclosure, the mattress retaining mechanism configured to impel at least a portion of the sidewall enclosure towards the interior of the sidewall enclosure to define a pocket between the mattress retaining mechanism and the floor panel;

wherein the sidewall enclosure and floor panel together define a receptacle for receiving a child, and wherein the receptacle is enclosed on all sides by the sidewall enclosure.

2. The child containment device of claim 1, further comprising a mattress and wherein a portion of the mattress is received in the pocket.

3. The child containment device of claim 1, wherein the mattress retaining mechanism comprises a flexible strap.

4. The child containment device of claim 3, wherein the flexible strap is formed from a resilient elastic material.

5. The child containment device of claim 4, wherein the flexible elastic strap is sewn to the sidewall enclosure.

6. The child containment device of claim 3, further comprising an adjustment buckle for selectively adjusting the length of the flexible strap.

7. The child containment device of claim 3, wherein the mattress retaining mechanism comprises a selectively engageable and disengageable fastener.

8. The child containment device of claim 3, wherein the mattress is substantially sized and shaped to match the size and shape of the floor panel.

9. The child containment device of claim 1 wherein the sidewall enclosure comprises at least two sidewall panels coupled together at a vertical edge and extending at an angle relative to each other.

10. The child containment device of claim 9, wherein the flexible strap is positioned at or near the vertical edge and is oriented perpendicularly to the length of the edge.

11. The child containment device of claim 2, wherein the mattress comprises at least one substantially rigid floor panel and a cushion.

12. The child containment device of claim 11, wherein the mattress comprises at least two substantially rigid floor panels hingedly connected to each other.

13. The child containment device of claim 1, further comprising a frame configured to support the child receiving receptacle.

14. A child containment device comprising:

a sidewall enclosure comprising one or more sidewall panels;

a floor panel coupled to the sidewall enclosure;

a mattress positioned on the floor panel; and at least one resilient strap coupled to the sidewall enclosure proximate and above the floor panel and distal from a top edge of the sidewall enclosure, the at least one strap being configured to bias at least a portion of the sidewall enclosure towards the interior of the sidewall enclosure to define a pocket between the at least one strap and the floor panel;

wherein the sidewall enclosure and floor panel together define a receptacle for receiving a child, and wherein the receptacle is enclosed on all sides by the one or more sidewall panels, and wherein a portion of the mattress is received in the pocket.

* * * * *